US006305106B1

(12) United States Patent
McLellan

(10) Patent No.: US 6,305,106 B1
(45) Date of Patent: Oct. 23, 2001

(54) APPARATUS FOR RELEASABLY COUPLING AN ATTACHMENT TO AN EXCAVATOR

(76) Inventor: Robin S. McLellan, 937 Barber Street, Clearwater, British Columbia (CA), V0E 1N0

( * ) Notice: Subject to any disclaimer, the term of this patent is extended or adjusted under 35 U.S.C. 154(b) by 0 days.

(21) Appl. No.: 09/792,908

(22) Filed: Feb. 23, 2001

(51) Int. Cl.[7] ..... E02F 3/96
(52) U.S. Cl. ..... 37/468; 414/723
(58) Field of Search ..... 37/468, 403–410; 414/723, 724

(56) References Cited

U.S. PATENT DOCUMENTS

| | | | |
|---|---|---|---|
| 5,024,010 | 6/1991 | Hulden . | |
| 5,692,325 | 12/1997 | Kuzutani | 37/468 |
| 5,966,850 | 10/1999 | Horton | 37/468 |
| 5,967,738 | 10/1999 | Warthold | 37/468 X |
| 6,058,633 | 5/2000 | Barden | 37/468 |

*Primary Examiner*—Christopher J. Novosad

(74) *Attorney, Agent, or Firm*—Kolisch Hartwell Dickinson McCormack & Heuser

(57) ABSTRACT

A quick, reliable and safe coupling device that is not mechanically complex is required for excavation equipment and more particularly, for coupling an attachment to a mounting bracket on an operating arm of an excavating machine. The present invention addresses the above needs by providing, a wedge member movable between a locked position and a released position; an extendable actuator that is movable between a collapsed position and an extended position to move the wedge member between the locked and released positions, respectively; and at least one guide member cooperating with the wedge member to guide movement of the wedge member between the locked and released positions. The wedge member may have opposed wedge end portions engageable with the attachment and the mounting bracket to define the locked position and an intermediate portion connected to a distal end of the actuator, the intermediate portion being shaped to provide clearance for the extendable actuator to move to the collapsed position. The apparatus may be connected directly to the mounting bracket. Alternatively, a base plate may be provided to retrofit the apparatus to the mounting bracket.

14 Claims, 5 Drawing Sheets

APPARATUS FOR RELEASABLY COUPLING AN ATTACHMENT TO AN EXCAVATOR

BACKGROUND OF THE INVENTION

1. Field of Invention

This invention relates generally to excavation equipment and more particularly to apparatus for releasably coupling an attachment to a mounting bracket on an operating arm of an excavating machine.

2. Description of Related Art

Excavators are generally equipped with a work implement or an attachment for performing useful work. Such attachments include digging and material handling buckets, drills, hydraulic hammers, and the like. Excavators typically include an operating arm, which have work implements attached thereto.

During operation of the excavator, it is often desirable to exchange one work implement for another. Thus, it may be necessary, depending upon the circumstances at hand, to remove an attachment in exchange for a more suitable work implement.

Disconnecting a work implement in exchange for another is often difficult, dangerous and time consuming. An operator of the operating arm must leave the cab of the excavator, disconnect a number of pins, bolts, or other types of fasteners that mechanically couple the attachment to the operating arm. The operator must then return to the cab of the excavator and reposition the operating arm adjacent the "new" work implement. After repositioning the operating arm, the operator must again leave the cab of the excavator and mechanically couple the "new" work implement to the operating arm by reconnecting a number of pins, bolts, or other types of fasteners. During the time in which to exchange or swap work implements, the excavator is idle thereby decreasing the efficiency or productivity of the excavator. As well, when disconnecting and reconnecting various work implements, the operator may be subjected to harsh environments, thereby posing a serious risk to the operator's well-being.

In order to safely and quickly couple and decouple work implements, a variety of devices have been designed: U.S. Pat. No. 5,024,010 to Hulden, F., U.S. Pat. No. 5,692,325 to Kuzutani, K., U.S. Pat. No. 5,966,850 to Horton, L. A., U.S. Pat. No. 5,967,738 to Warthold, J., and U.S. Pat. No. 6,058,633 to Barden, W. M. Such devices typically include an apparatus that attempts to quickly and easily mechanically couple and decouple the work implement to and from the operating arm. However, these devices are relatively complex mechanically and tend to rely on a large number of components, thereby increasing the costs associated with the excavator and decreasing the reliability of operation in the harsh operating environment of an excavator.

What is needed therefore is a quick, reliable and safe coupling device, which overcomes one or more of the aforementioned drawbacks. What is further required is a quick coupling device that is less mechanically complex relative to other devices, which have heretofore been designed.

SUMMARY OF THE INVENTION

The present invention addresses the above needs by providing an apparatus for quickly, reliably and safely releasably coupling an attachment to a mounting bracket on an operating arm of an excavating machine.

In accordance with one aspect of the invention there is provided an apparatus for releasably coupling an attachment to a mounting bracket on an operating arm of an excavating machine. The apparatus may include a wedge member movable between a locked position to lock the attachment to the mounting bracket and a released position to permit removal of the attachment from the mounting bracket; an extendable actuator that is movable between a collapsed position and an extended position to move the wedge member the locked and released positions, respectively; and at least one guide member cooperating with the wedge member to guide movement of the wedge member between the locked and released positions. The wedge member may have opposing wedge end portions engageable with the attachment and the mounting bracket to define the locked position and an intermediate portion connected to a distal end of the actuator, the intermediate portion being shaped to provide clearance for the extendable actuator to move to the collapsed position.

The apparatus may further include a base plate connected to a proximal end of the actuator to permit the actuator to connect to the mounting bracket.

The at least one guide member may be an elongated threaded member to threadedly connect the base plate to the mounting bracket. The mounting bracket may form an S-group quick coupling with the attachment.

The extendable actuator may be a hydraulic cylinder and it may include a lock check valve. Further, the extendable actuator may be operable remotely.

In accordance with another aspect of the invention there is provided an apparatus for releasably coupling an attachment to a mounting bracket on an operating arm of an excavating machine. The apparatus may include a wedge member movable between a locked position to lock the attachment to the mounting bracket and a released position to permit removal of the attachment from the mounting bracket; an extendable actuator movable between a collapsed position and an extended position to move the wedge member between the locked and released positions, respectively; at least one guide member cooperating with the wedge member to guide movement of the wedge member between the locked and released positions; and a base plate connected to a proximal end of the actuator to permit the actuator to connect to the mounting bracket. The wedge member may have opposing wedge end portions engageable with the attachment and the mounting bracket to define the locked position and an intermediate portion connected to a distal end of the actuator, the intermediate portion being shaped to provide clearance for the extendable actuator to move to the collapsed position.

The at least one guide member may be an elongated threaded member to threadedly connect the base plate to the mounting bracket. The mounting bracket may form an S-group quick coupling with the attachment.

The extendable actuator may be a hydraulic cylinder and it may include a lock check valve. Further, the extendable actuator may be operable remotely.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
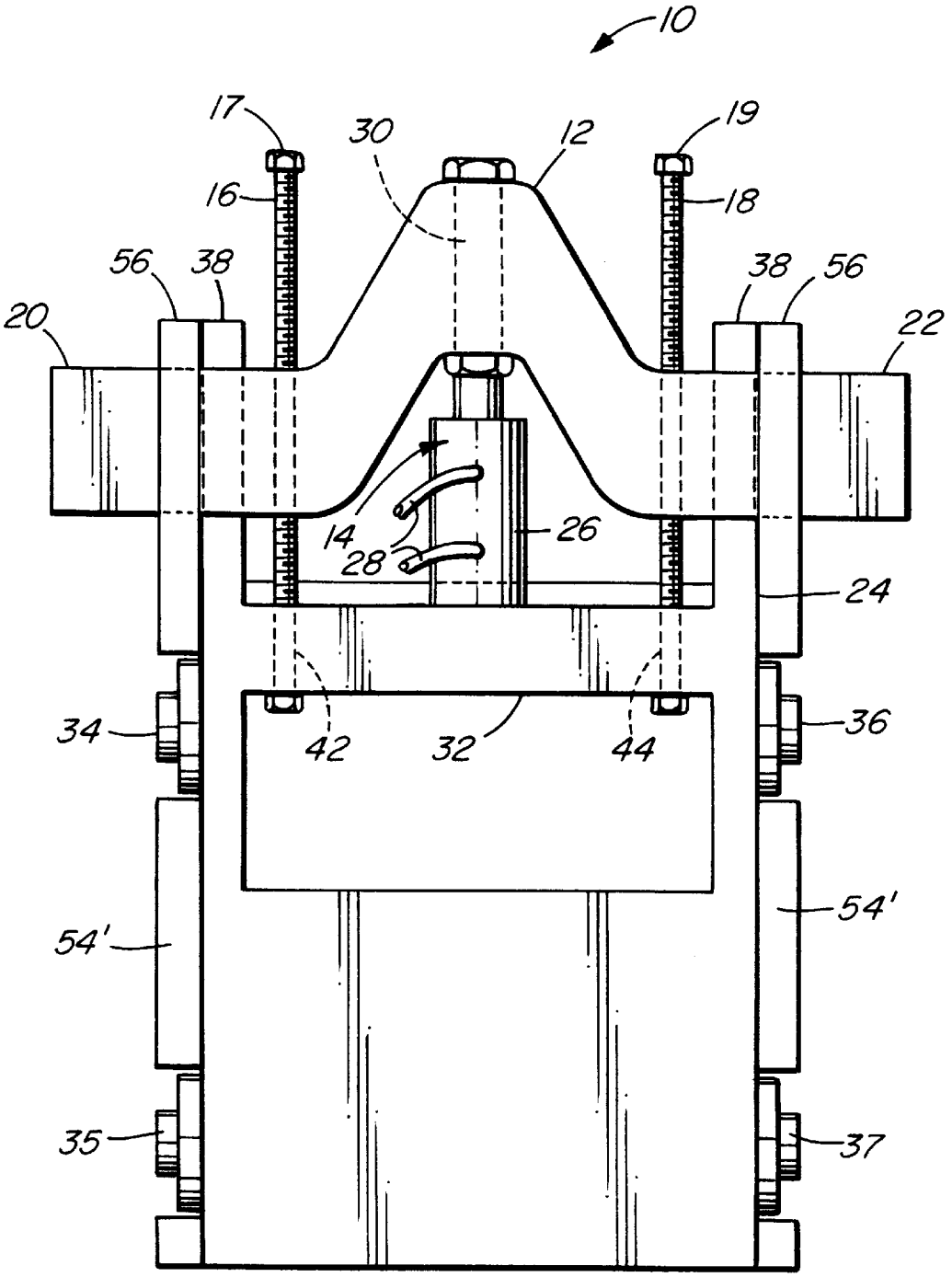
FIG. 1 is a top view of a mounting bracket with an apparatus for releasably coupling an attachment to a mounting bracket on an operating arm of an excavating machine in an engaged position
Figure 1A:
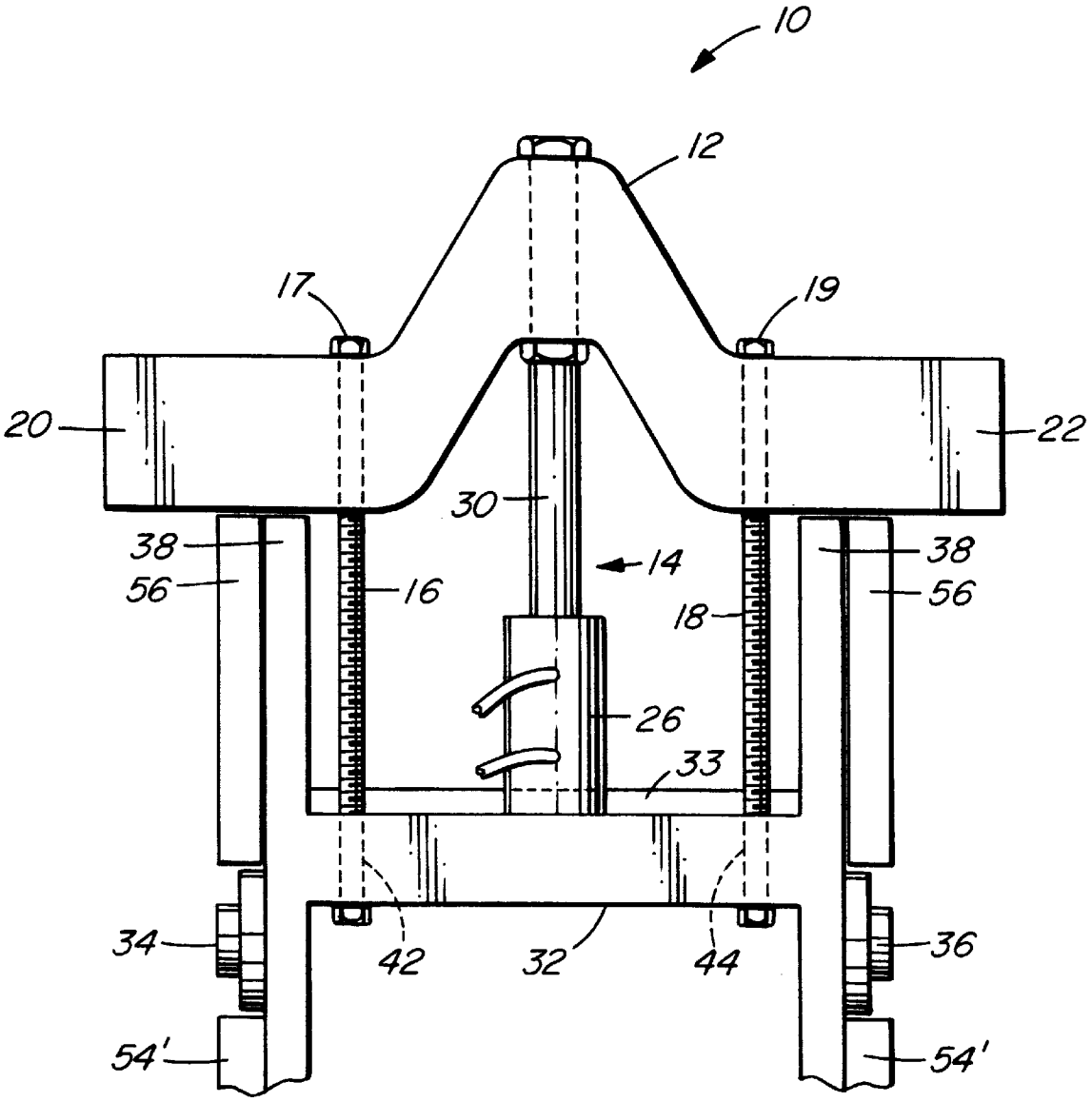
FIG. 1A is portion of the top view in FIG. 1 in a disengaged position
Figure 2:
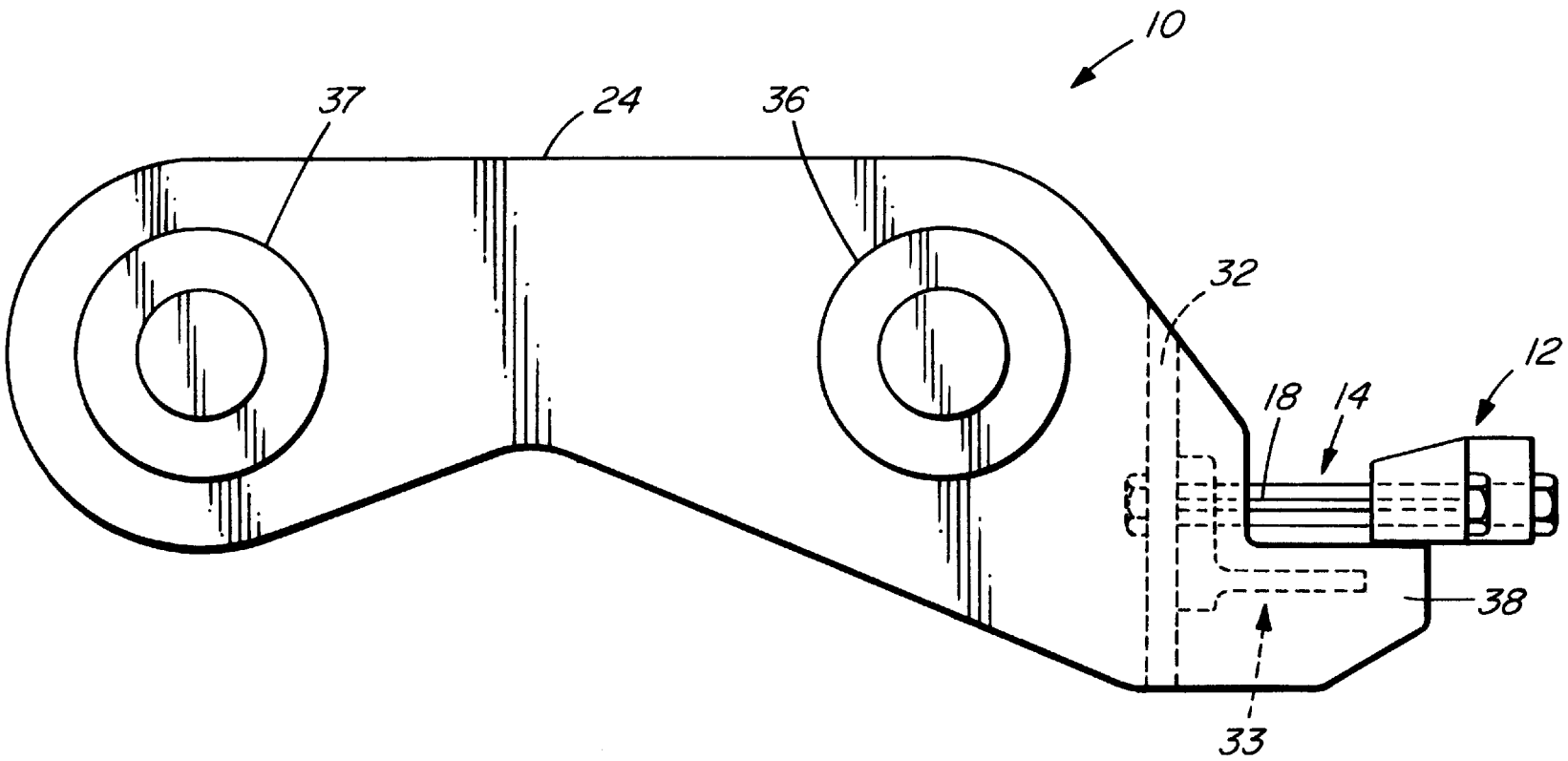
FIG. 2 is a side view of a mounting bracket and apparatus depicted in FIGS. 1 and 1A

Referring to FIGS. 1, 1A, and 2, an apparatus according to a first embodiment of the invention is shown generally at 10. The apparatus 10 includes a wedge member 12, an extendable actuator 14, and first and second guide members 16, and 18.

The wedge member 12 has opposing wedge end portions 20 and 22 engageable with an attachment (not shown for ease of illustration) and the mounting bracket 24. The wedge member 12 is shaped to provide clearance for the extendable actuator 14 to move the wedge member 12 between an engaged position, in which the attachment is locked into place to the mounting bracket 24, and a disengaged position, in which the attachment is unlocked from the mounting bracket 24. The wedge member's 12 shape may be formed by welding or fastening segments of material together to form a generally "U" shape middle region with elongated end portions 20 and 22. Preferably, the wedge member 12 may be formed from one continuous segment of material to form a generally "bull-horn" shape. It will be appreciated that the wedge member may be formed by a variety of materials suitable for carrying a load. For example, the wedge may be formed with high tensile steel or a composite alloy.

The extendable actuator 14 is movable between a collapsed position and an extended position to move the wedge member 12 between the engaged and disengaged positions, respectively. It should be appreciated that to move the wedge member 12 between positions, the extendable actuator 14 may be hydraulic or electric and may be one of several devices, for example, a screw system, a scissor mechanism, or a telescoping member, all of which are known in the art.

Preferably, the extendable actuator 14 includes a hydraulic pressure cylinder 26 with hydraulic lines 28 for supplying hydraulic fluid to the pressure cylinder, and a movable piston rod 30 carried by the pressure cylinder. Preferably, the extendable actuator 14 includes a lock check valve to lock the wedge member 12 in place in the event that the hydraulic line 28 experiences a sudden drop in pressure. The extendable actuator 14 may be operable from within the safe confines of the cab of the excavator by virtue of control means that communicate with the extendable actuator 14 via the hydraulic lines 28. The extendable actuator 14 may be directly connected to the cross bar 32 of the mounting bracket 24 by means of welds, bolts or pins or other similar fasteners. Alternatively, a base plate 33 may be provided to connect the actuator to the mounting bracket 24 be means of threaded members. These members are discussed in more detail below.

By way of example, the figures show a mounting bracket 24 that forms an S-group quick coupling with bucket attachment 52 by means of pins 34, 35, 36 and 37 disposed on either sides of mounting bracket 24. It will be appreciated that the apparatus of the present invention is not limited to use with an S-group quick coupling. Couplings that rely on a wedge or a wedge member to lock together a mounting bracket and an attachment are suitable for use with the apparatus of the present invention. Mounting bracket 24 includes conventional threaded receiving openings 42 and 44.

Coupling apparatus 10 employs first and second guide members 16 and 18 to guide the wedge member 12 by limiting the wedge member's rotation about the piston rod 30 and by limiting the wedge member's movement about the mounting bracket 24, as the extendable actuator 14 draws the wedge member to the engaged position. To minimize the mechanical complexity of the apparatus 10, the guide members 16 and 18 are preferably elongated threaded members that are threadedly received in the existing threaded openings 42 and 44 of the mounting bracket 24. The elongated threaded members may simply connect to the mounting bracket 24 to guide the wedge member 12, or if one desires, the elongated threaded members may also be used to fasten the base plate 33 to the mounting bracket. The elongated threaded members may by capped by nuts 17 and 19, respectively as a safety retainer to limit the wedge member's movement as the extendable actuator 14 moves the wedge member 12 to a disengaged position. One skilled in the art will appreciate that other means for guiding the wedge member 12 may be employed, including a single elongated threaded member.

Referring again to FIGS. 1 and 2 an apparatus according to a second embodiment of the invention is also shown generally at 10. The apparatus 10 includes the same elements and reference numbers as those found in the first embodiment. In the second embodiment, the apparatus may be provided as a retro-fit apparatus, in which case, base plate 33 is used to connect the actuator to the mounting bracket 24 be means of the elongated threaded members.

Operation

Figure 3:
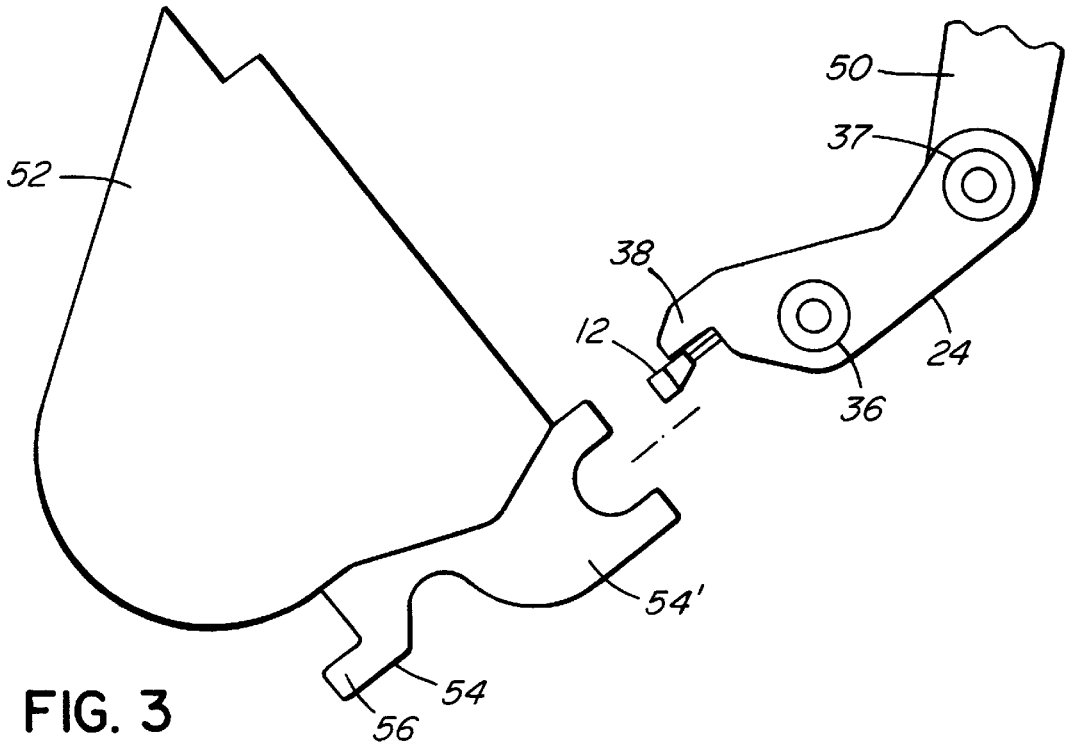
FIG. 3 is a side view of an operating arm with a mounting bracket with a disengaged wedge positioned over an attachment
Figure 4:
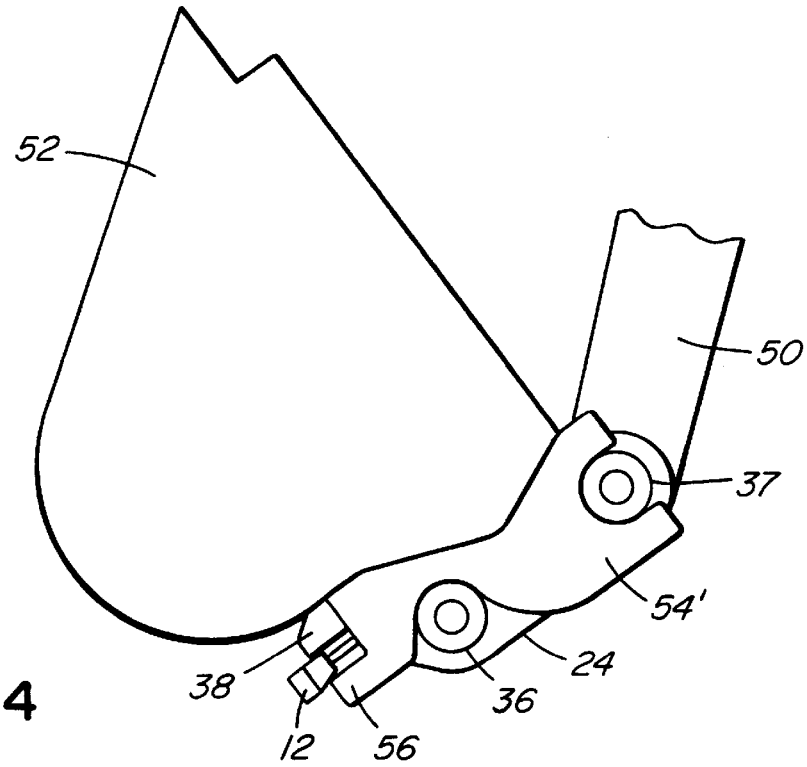
FIG. 4 is a side view of an operating arm with a mounting bracket with an engaged wedge coupling an attachment

FIG. 3 depicts an operating arm 50 attached to the mounting bracket 24. Mounting bracket 24 is pivotally attached to operating arm 50 at pins 35 and 37. Bracket 24 includes a disengaged wedge member 12. Bucket attachment 52 includes an attaching bracket 54 comprising a pair of spaced side plates 54' dimensioned to straddle mounting bracket 24 and cooperate with mounting bracket 24 to couple the bucket to operating arm 50 in an S-group quick coupling arrangement. As best shown in FIG. 1, sideplates 54' define a pair of spaced outer flanges 56 that are positioned adjacent inner flanges 38 on mounting bracket 24. When the operator of the excavator (not shown) decides to attach the attachment 52 to the mounting bracket 14, the operator can safely, from inside the cab of the excavator, moves the wedge member 12 to a disengaged position by employing the extendable actuator 14 and positions mounting bracket 24 over the bucket attachment 52. The operator then positions mounting bracket 24 between side plates 54' of attaching bracket 54 so that linkage pins 34, 35, 36 and 37 engage the attaching bracket 54 of the attachment 52.

Figure 5:
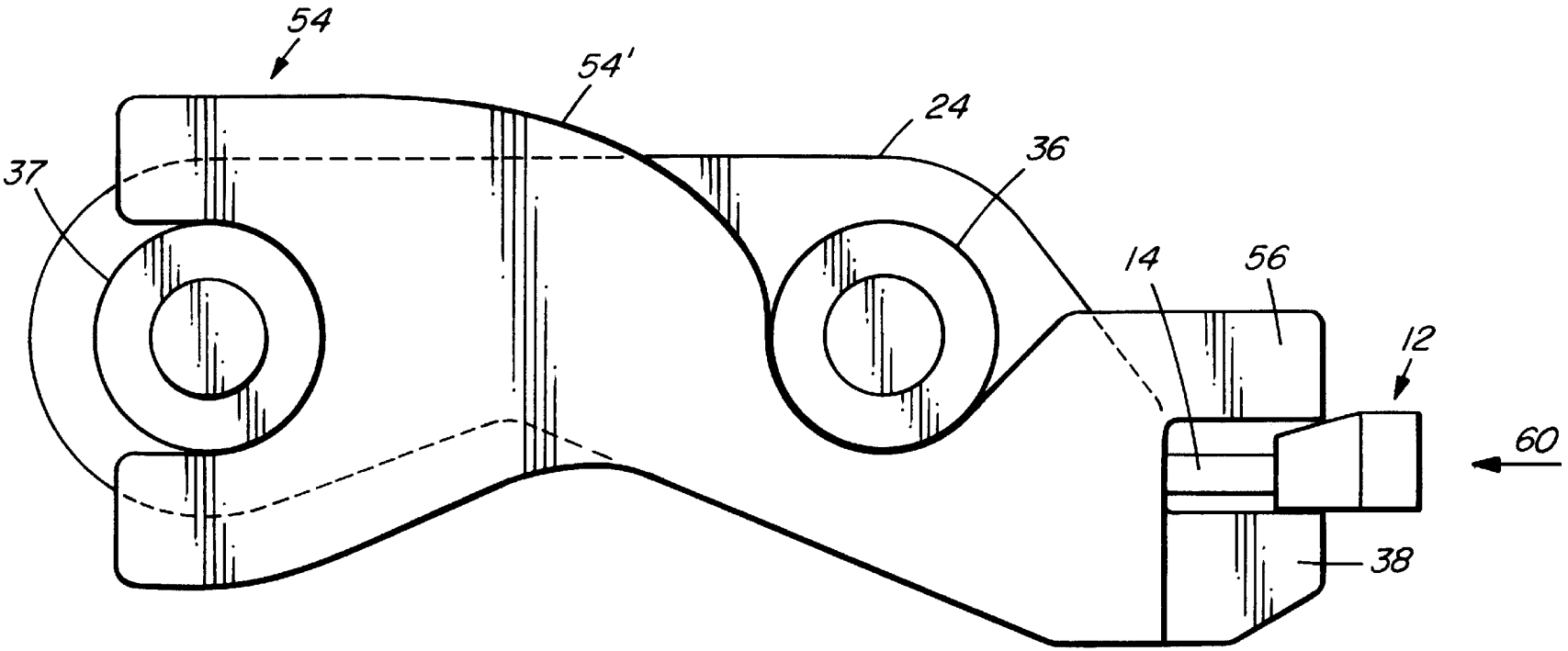
FIG. 5 is a side view of a mounting bracket with an engaged wedge coupling a attaching bracket of an attachment

As best shown in FIG. 5, locking mounting bracket 24 and attaching bracket 54 together, involves the operator activating extendable actuator 14 to draw the wedge member 12 in the direction of activating arrow 60, into an engaged position between inner flanges 38 of mounting bracket 24 and outer flanges 56 of attaching bracket 54.

To replace an attachment, the operator simply sets the attachment on the ground with the operating arm 50. The operator can then disengage the wedge member 12 and move the operating arm 50 to another attachment to perform another task.

While specific embodiments of the invention have been described and illustrated, such embodiments should be considered illustrative of the invention only and not as limiting the invention as construed in accordance with the accompanying claims.

What is claimed is:

1. An apparatus for releasably coupling an attachment to a mounting bracket on an operating arm of an excavating machine, comprising:

a wedge member movable between a locked position to lock the attachment to the mounting bracket and a released position to permit removal of the attachment from the mounting bracket;

an extendable actuator that is movable between a collapsed position and an extended position to move the wedge member between the locked and released positions, respectively; and at least one guide member cooperating with the wedge member to guide movement of the wedge member between the locked and released positions;

the wedge member having opposed wedge end portions engageable with the attachment and the mounting bracket to define the locked position and an intermediate portion connected to a distal end of the actuator, the intermediate portion being shaped to provide clearance for the extendable actuator to move to the collapsed position.

2. The apparatus of claim 1 further comprising a base plate connected to a proximal end of the actuator to permit the actuator to connect to the mounting bracket.

3. The apparatus of claim 2 wherein the at least one guide member is an elongated threaded member, said elongated threaded member threadedly connecting the base plate to the mounting bracket.

4. The apparatus of claim 1 wherein the mounting bracket and attachment form an S-group quick coupling, said attachment having an attaching bracket.

5. The apparatus of claim 4 wherein the hydraulic cylinder includes a lock check valve.

6. The apparatus of claim 1 wherein the extendable actuator comprises a hydraulic cylinder.

7. The apparatus of claim 1 wherein the extendable actuator is operable remotely.

8. An apparatus for releasably coupling an attachment to a mounting bracket on an operating arm of an excavating machine, comprising:

a wedge member movable between a locked position to lock the attachment to the mounting bracket and a released position to permit removal of the attachment from the mounting bracket;

an extendable actuator movable between a collapsed position and an extended position to move the wedge member between the locked and released positions, respectively;

at least one guide member cooperating with the wedge member to guide movement of the wedge member between the locked and released positions; and a base plate connected to a proximal end of the actuator to permit the actuator to connect to the mounting bracket;

the wedge member having opposed wedge end portions engageable with the attachment and the mounting bracket to define the locked position and an intermediate portion connected to a distal end of the actuator, the intermediate portion being shaped to provide clearance for the extendable actuator to move to the collapsed position.

9. The apparatus of claim 8 wherein the at least one guide member is an elongated threaded member, said elongated threaded member threadedly connecting the base plate to the mounting bracket.

10. The apparatus of claim 8 wherein the wedge member is a continuous member have opposing wedge end portions.

11. The apparatus of claim 8 wherein the mounting bracket forms an S-group quick coupling with the attachment having an attaching bracket.

12. The apparatus of claim 8 wherein the extendable actuator comprises a hydraulic cylinder.

13. The apparatus of claim 12 wherein the hydraulic cylinder includes a lock check valve.

14. The apparatus of claim 8 wherein the extendable actuator is operable remotely.

* * * * *